US009231326B2

(12) United States Patent
Goesmann et al.

(10) Patent No.: US 9,231,326 B2
(45) Date of Patent: Jan. 5, 2016

(54) HIGH-CURRENT PLUG-IN CONNECTOR FOR AUTOMOTIVE VEHICLE APPLICATIONS

(71) Applicants: BAYERISCHE MOTOREN WERKE AKTIENGESELLSCHAFT, Munich (DE); DIEHL METAL APPLICATIONS GMBH, Berlin (DE)

(72) Inventors: Hubertus Goesmann, Auernheim (DE); Paul Czechanowski, Zehdenick (DE); Harald Heck, Nuremberg (DE)

(73) Assignees: BAYERISCHE MOTOREN WERKE AKTIENGESELLSCHAFT, Munich (DE); DIEHL METAL APPLICATIONS GMBH, Berlin (DE)

( * ) Notice: Subject to any disclaimer, the term of this patent is extended or adjusted under 35 U.S.C. 154(b) by 61 days.

(21) Appl. No.: 14/355,269

(22) PCT Filed: Oct. 31, 2012

(86) PCT No.: PCT/EP2012/004552
§ 371 (c)(1),
(2) Date: Apr. 30, 2014

(87) PCT Pub. No.: WO2013/064249
PCT Pub. Date: May 10, 2013

(65) Prior Publication Data

US 2014/0308857 A1 Oct. 16, 2014

(30) Foreign Application Priority Data

Nov. 3, 2011 (DE) ..... 10 2011 085 700

(51) Int. Cl.
*H01R 13/11* (2006.01)
*H01R 13/187* (2006.01)

(Continued)

(52) U.S. Cl.
CPC ..... *H01R 13/187* (2013.01); *H01R 13/17* (2013.01); *H01R 4/48* (2013.01); *H01R 13/193* (2013.01)

(58) Field of Classification Search
CPC ..... H01R 13/187; H01R 4/24; H01R 13/17; H01R 13/22; H01R 13/11
USPC ..... 439/842, 844, 847, 849, 850, 851, 852, 439/853, 862, 817, 858, 861, 786, 787, 834
See application file for complete search history.

(56) References Cited

U.S. PATENT DOCUMENTS 2,735,998 A * 2/1956 Martines ..... H01R 13/115 439/849

(Continued)

FOREIGN PATENT DOCUMENTS

DE 3330984 3/1985
DE 20304748 7/2004

(Continued)

OTHER PUBLICATIONS

International Search Report and Written Opinion (no English translation available) for International (PCT) Patent Application No. PCT/EP2012/004552 mailed Jan. 25, 2013, 10 pages.

*Primary Examiner* — Abdullah Riyami
*Assistant Examiner* — Nader J Alhawamdeh
(74) *Attorney, Agent, or Firm* — Sheridan Ross PC

(57) ABSTRACT

A high-current (HC) plug-in connector for currents exceeding 100 A, in particular 200 A, is provided. The high-current (HC) plug-in connector may include a first connecting element having a first contact section, and a second connecting element having a second contact section. Furthermore, a spring element is provided for establishing an electrical connection between the first and the second connecting element. The spring element may include at least two clamping elements which are interconnected via at least one web, the web and respective first sections of the clamping elements being arranged on a first outer surface of the connection formed by the first and the second contact section, and second sections of the clamping elements being arranged at least in part on a second outer surface opposite the first outer surface. At least one contact spring is arranged on the at least one web, the at least one contact spring generating, on the first outer surface, a contact force oriented in the direction of the second outer surface, whereby mutually facing contact surfaces of the first and the second contact section are pressed against each other, the second sections of the clamping elements serving as abutments.

22 Claims, 5 Drawing Sheets

(51) Int. Cl.

| | |
|---|---|
| ***H01R 13/17*** | (2006.01) |
| *H01R 4/48* | (2006.01) |
| *H01R 13/193* | (2006.01) |

(56) References Cited

U.S. PATENT DOCUMENTS

| | | | | | |
|---|---|---|---|---|---|
| 2,742,628 | A * | 4/1956 | Batcheller | H01R 13/115 | 439/849 |
| 2,770,792 | A * | 11/1956 | Batcheller | H01R 13/115 | 439/849 |
| 5,588,884 | A * | 12/1996 | Rudoy | H01R 31/02 | 439/787 |
| 7,150,660 | B2 | 12/2006 | Allgood et al. | | |
| 7,241,189 | B2 | 7/2007 | Mohs et al. | | |
| 8,998,656 | B2 * | 4/2015 | Amano | H01R 13/113 | 439/845 |
| 2003/0109181 | A1 | 6/2003 | Bungo | | |
| 2003/0194919 | A1 * | 10/2003 | Hsieh | H01R 13/5205 | 439/845 |

FOREIGN PATENT DOCUMENTS

| | | |
|---|---|---|
| DE | 102008009357 | 12/2010 |
| DE | 102010008536 | 8/2011 |
| DE | 102010062580 | 6/2012 |
| FR | 2517480 | 6/1983 |
| FR | 2709881 | 3/1995 |
| FR | 2740266 | 4/1997 |
| GB | 2228150 | 8/1990 |

* cited by examiner

HIGH-CURRENT PLUG-IN CONNECTOR FOR AUTOMOTIVE VEHICLE APPLICATIONS

CROSS REFERENCE TO RELATED APPLICATIONS

This application is a national stage application under 35 U.S.C. 371 and claims the benefit of PCT Application No. PCT/EP2012/004552 having an international filing date of Oct. 31, 2012, which designated the United States, which claims the benefit of German Patent Application No. 10 2011 085 700.1 filed Nov. 3, 2011, the entire disclosure of both the above-identified applications are incorporated by reference herein.

The present invention refers to a high-current plug-in connector for currents exceeding 100 amperes, particularly 200 amperes. Such a HC plug-in connector comprises a first connecting element having a first contact section and a second connecting element having a second contact section. A spring element serves to establish an electrical connection between the first and the second connecting element. The two connecting elements are each connected to an electrical conductor.

High-current (HC) plug-in connectors are e.g. used for the electrical connection of energy storage modules of an energy storage device in automotive vehicles. Such energy storage devices are inter alia used in battery-operated automotive vehicles and in automotive vehicles that can be operated electrically and also with internal combustion engines. Due to the great power required by drive motors, and due to a voltage of the energy storage devices that is not arbitrarily high, very high currents may arise in such energy storage modules during operation. For reasons of manufacturing efficiency, but also for reasons of reliability, not only screwed connections are used for the electrical connection of individual components, but also connections in which two connecting elements are interconnected by way of a plug-in connection.

In known HC plug-in connectors, a spring element, e.g. in the form of a contact lamella, is arranged between the first connecting element and the second connecting element. The spring element is often mechanically connected to one of the two contact partners. Respective cables or lines are mounted at the connecting elements, said cables or lines being connected at their respective other end to an electrical component of the energy storage device, an electrical component operated by the energy storage device, or another connection element. One drawback of this plug-in connection is that there exists a small contact area between the spring element and the connecting elements for current transfer. This results in increased contact resistances leading to an increased temperature.

Therefore, in order to keep the contact resistance low, at least the contact surfaces of the connecting elements are provided with a coating. As a rule, the coating consists of silver which has excellent conductivity properties. For reasons of costs the coating is formed with a thickness of not more than 10 μm.

It is the object of the present invention to indicate a high-current plug-in connector which at a comparable current-carrying capacity shows a lower contact resistance.

This object is achieved by a high-current plug-in connector according to the features of patent claim 1. Advantageous configurations follow from the dependent claims.

The invention provides a high-current plug-in connector for currents exceeding 100 amperes, in particular 200 amperes, the connector comprising: a first connecting element, a second connecting element and a spring element. The first connecting element has a first contact section. The second connecting element has a second contact section. The spring element serves to establish an electrical connection between the first and the second contact section. The spring element comprises at least two clamping elements which are interconnected via at least one web, the web and respective first sections of the clamping elements being arranged on a first outer surface of the connection formed by the first and the second contact section, and second sections of the clamping elements being arranged at least in part on a second outer surface opposite the first outer surface. At least one contact spring is arranged on the at least one web, said at least one contact spring generating, on the first outer surface, a contact force oriented in the direction of the second outer surface, whereby mutually facing contact surfaces of the first and second contact section are pressed against each other, the second sections of the clamping elements serving as abutments.

The invention makes it possible that the first and the second contact section are in direct contact with each other. Since the first and the second contact section are in direct contact with each other, one obtains a contact surface which is larger by comparison with the prior art. Hence, the lower contact resistances now occurring in the contact area also entail lower temperatures. A longer lifetime of the plug-in connection can be accomplished due to the temperatures that are lower during operation on account of the lower contact resistances.

To bring the contact sections of the first and the second connecting element into a flat contact for producing the low-resistance electrical contact, a spring element is provided, which is acting from the outside on the contact sections. The spring element is particularly formed as a component which is independent of the first and/or second connecting element and which is producible and/or processible independently of the connecting elements. This permits not only the safe establishment of the electrical contact by the spring element pressing the two contact sections in a defined manner onto each other, but also ensures a comparatively smaller installation volume and lower weight of the plug-in connector.

This also leads to a particularly simple implementation of the plug-in connector because the first and the second connecting elements are in contact with each other only at one side mechanically and thus electrically. The mutually facing contact areas are configured in a corresponding manner. Preferably, the connecting elements and their contact sections, respectively, are made plane and flat. The connecting elements may also be ball-shaped and dome-shaped (concave and convex). This ensures a high surface contact for current transfer.

The contact sections of the first and the second connecting elements are interconnected in a force-locking manner via the spring element. This makes the contact sections disconnectable after removal of the contact force. At the same time this configuration makes it possible to establish the connection also in a forceless manner.

According to an expedient configuration, at least one contact spring is respectively arranged on the at least one web on opposite sides. A respective contact force for clamping the contact sections of the connecting elements is thereby applied laterally relative to a plug-in direction of the connecting elements. Plug-in direction of the connecting elements stands for a direction in which the connecting elements are (must be) moved relative to each other to make the contact sections of the connecting elements first congruent in order to produce the contact force subsequently.

According to a further expedient configuration, the at least one contact spring has a wave profile, wherein the wave profile, starting from the web, has at least a wave peak and then a wave valley which is in contact with the first outer surface and which generates the contact force. Wave peak stands for a curvature oriented away from the connection. Wave valley correspondingly means a curvature of the wave profile which is oriented towards the connection. The wave profile can be produced in a simple manner by way of a shaping process.

Specifically, the at least one contact spring can extend in parallel with the clamping elements and perpendicular to a plug-in direction of the first and the second connecting element for establishing the plug-in connection of the plug-in connector. This means that the extension of successive wave peak and wave valley is in parallel with the elements and approximately perpendicular to the plug-in direction of the connecting elements for the establishment of the plug-in connection.

Furthermore, it may be provided that, starting from the web, the last wave valley of the wave profile passes into a T-shaped section, wherein the opposite arms of the T-shaped section have a deformation facing away from the connection. The contact force can thereby be varied by actuating the arms of the T-shaped section, for instance to establish or disconnect the connection. Specifically, it is thereby possible to establish or disconnect the connection in a forceless manner.

Specifically, the spring element comprises at least two clamping elements extending in parallel with each other, wherein the at least one contact spring is arranged between two respective clamping elements. The number of the clamping elements of the spring element and the distance between two respective clamping elements depend inter alia on the question over which surface or length the contact sections are to form the electrical connection. Moreover, the contact force acting over the surface can be produced in a defined manner through the number and distribution of the contact springs.

According to a further expedient configuration respective ends of a clamping element, particularly on the second outer surface of the connection, are interconnected mechanically, especially by way of a form closure or a material bond. Furthermore, the clamping elements that are guided from the same side towards the second outer surface can be interconnected, e.g. in that these terminate in a respective end-sided flat section. The mechanical connection is then established by means of the two end-sided flat sections lying on the second outer surface. Preferably, the end-sided flat sections are dimensioned such that these are in mechanical contact with a large part of the second outer surface. The abutment required for generating the contact force is also formed thereby in a reliable manner.

According to a further expedient configuration the spring element on an inner one of the clamping elements comprises a stop shoulder extending in the direction of the contact force. The stop shoulder serves to introduce one of the two connecting elements into the spring element for the purpose of establishing the connection over a defined length, resulting in a predetermined contact surface between the two connecting elements.

Furthermore, it is expedient when the inner clamping element has formed thereon at least one lug that encloses one of the connecting elements in the area of a constriction to connect the spring element in a form-locking manner to said connecting element. This ensures, on the one hand, a defined position of this connecting element relative to the spring element. On the other hand, in cooperation with the stop shoulder, this ensures the just mentioned defined position of the contact surfaces of the two connecting elements relative to one another.

According to a further expedient configuration, the plug-in connector after establishment of the connection between the first and the second connecting element is surrounded by an insulating housing, particularly made of plastics. Since the high-current plug-in connector is provided for high currents and high voltages, a reliable insulation of the connection is required and provided by the insulating housing.

The housing preferably serves not only to insulate the connection, but simultaneously takes over a function for establishing or disconnecting the connection consisting of the two connecting elements. Expediently, the housing comprises at least one guide section with a path which, when the housing is mounted on the spring element in an intermediate position, lifts off the at least one contact spring against its spring force from the connection to be established so as to permit a forceless introduction of the connecting element, which is not connected to the spring element, into the spring element in plug-in direction, wherein in an end position of the housing the at least one guide section is not in engagement with the spring element so as to permit the generation of the contact force by the spring element.

In a further expedient configuration, the contact sections of the connecting elements are made flat, particularly plane or concave or convex.

It is particularly provided that the spring element is made from special steel so as to be able to exert the contact force needed for generation on the connection.

It is expedient when the at least one contact spring, the at least one web, and the at least two clamping elements are made as one part, i.e., integral. In other words, this means that the spring element is preferably made from a piece of metal, particularly special steel.

Selectively, the first and/or the second connecting element consist of aluminum or an aluminum alloy. Likewise, the first and/or the second connecting element may consist of copper or a copper alloy. It primarily follows from the material of a further connection partner, which must be contacted with the corresponding connecting element, from which material the first and the second connecting element, respectively, are made. When the connection partner consists of aluminum, it is expedient that the connecting element is also made of aluminum so as to be able to establish a safe electrical connection, which is as simple as possible, between said two components.

However, it is also possible to provide one of the two connecting elements of aluminum and the other of the two connecting elements of copper (or their respective alloys). It is specifically provided in this case that the first and/or the second connecting element comprise a first and a second coating in the area of their respectively adjoining contact sections. It goes without saying that such a coating can also be provided whenever the two connecting elements consist of the same materials or alloys. An advantage of the provision of the coating is that the lifetime of the plug-in connection can be prolonged by protecting the surface of the contact sections from oxidation. This is particularly of importance to connecting elements consisting of aluminum, which upon contact with oxygen oxidize very rapidly. When the connecting elements consist of different materials—as explained at the outset, the provision of the coating additionally serves the protection against contact corrosion due to an otherwise arising electrochemical series.

It is particularly expedient when the first and/or the second coating have a layer of tin or of a tin alloy. In comparison with the otherwise used silver, tin can be provided at a relatively low price, whereby the costs for the production of the plug-in connection can be reduced. To avoid contact corrosion due to the electrochemical series, it may further be provided that the first and/or the second coating between the tin or the tin alloy as the outermost layer (surface coating) comprise a first intermediate layer of copper and/or a second intermediate layer of nickel or the alloys thereof. Depending on whether and if one or plural intermediate layers are provided, the corresponding materials can be chosen in response to the material of the two connecting elements to avoid problems due to the electrochemical series.

It is further expedient when the first and/or the second coating (surface coating) have a total thickness of more than 10 μm, particularly more than 20 μm, wherein the maximum total thickness of the first and/or the second coating is 100 μm, preferably 50 μm. The greater the thickness that has been chosen for the coating, the smaller is the risk of an oxidation of connecting elements consisting particularly of aluminum and the alloys thereof. The risk of such an oxidation is due to the fact that the coating typically wears off in the course of the lifetime of the plug-in connection and the surface of the material of one of the connecting elements may thereby get exposed unintentionally. This risk is the greater, the thinner the layer thickness is. Specifically, it has been found that the problem arises whenever the layer thickness is less than 10 μm. Due to the much lower price of the preferred tin as the coating the layer thickness can be applied without any problem with a thickness of up to 100 μm to the contact sections of the connecting elements. By contrast, a corresponding layer thickness of silver, which is used in the prior art as a coating agent for providing a high conductivity, would just raise the costs of the plug-in connection in practice to an unacceptably high level. The coating can e.g. be applied galvanically. Likewise, other suitable methods can be used. Preferably, the coating has a copper sub-layer with a thickness of 1 μm to 20 μm, particularly 2 μm to 8 μm, or a nickel sub-layer as the intermediate layer.

Furthermore, a cover layer of copper and/or a copper alloy and/or nickel and/or a nickel alloy and/or silver and/or a silver alloy and/or gold and/or a gold alloy can selectively be applied to the first and/or the second coating in addition. Preferably, the cover layer has a thickness of 0.01 μm to 5 μm, particularly a thickness of 0.1 μm to 0.3 μm.

The coating of the contact surfaces of the contact sections can be applied for instance galvanically and/or by hot-dip coating and/or by deposition from the gas phase and/or by flame and/or by plasma spraying and/or by compacting.

The invention shall now be explained in more detail with reference to an embodiment in the drawing, in which.

Figure 1:
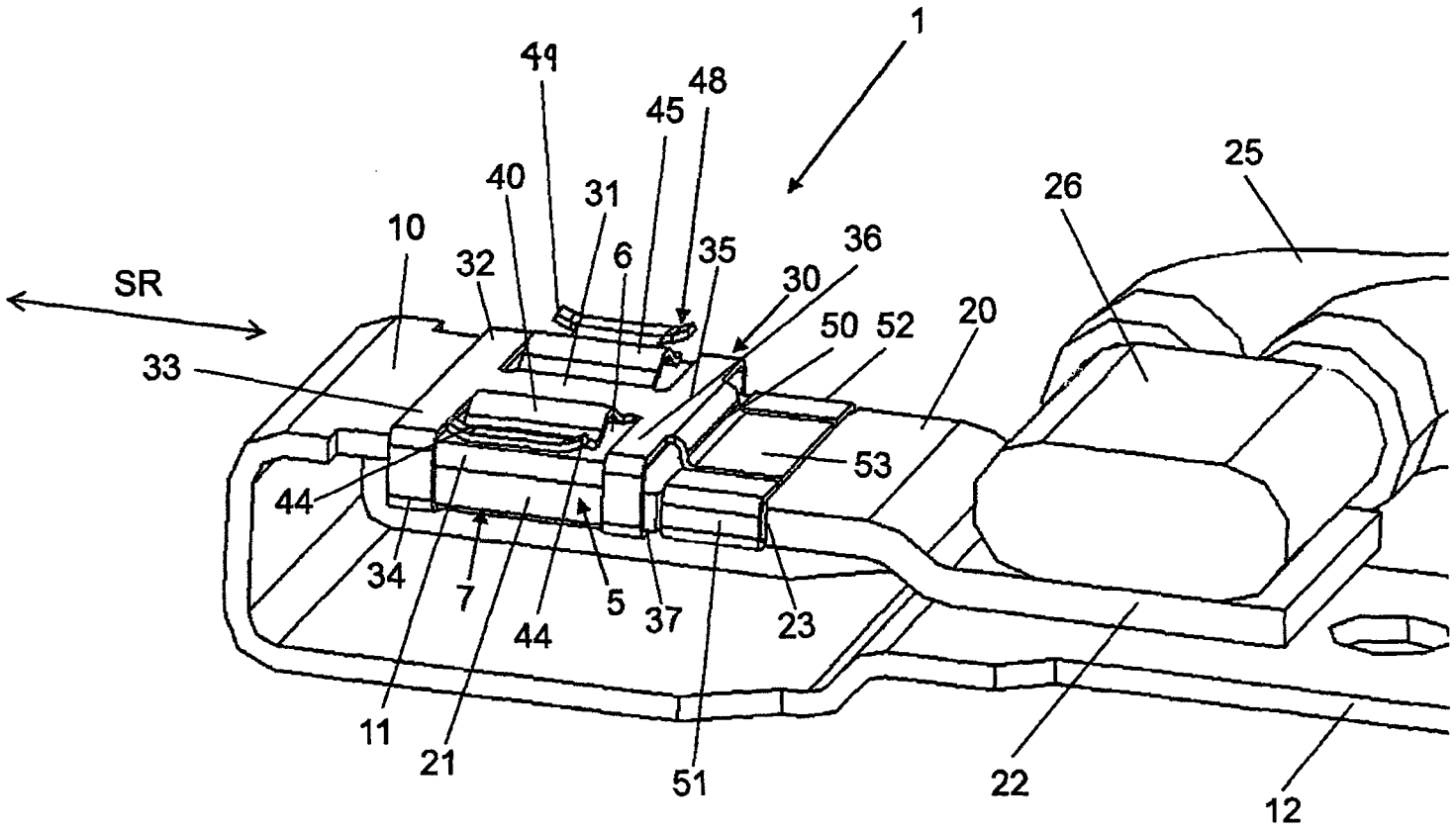
FIG. 1 is a perspective illustration of a high-current plug-in connector according to the invention without a housing surrounding the connection.

In the illustrations described hereinafter, a high-current (HC) plug-in connector according to the invention is shown in various perspective and cut views. The HC plug-in connector is suited for currents exceeding 100 A, or even 200 A. Currents in this order of magnitude occur e.g. in energy storage devices for drive machines in automotive vehicles.

The HC plug-in connector 1 comprises a first connecting element 10 and a second connecting element 20. The first connecting element 10 has a first contact section 11; the second connecting element 20 has a second contact section 21. The first and the second contact sections 11, 21 are configured to be flat, i.e. plane, as flat pieces in the embodiments. The contact sections may also be configured to be concave and convex. The connecting elements 10, 20 are brought into contact in a co-planar manner for establishing an electrical connection 5 in the area of their contact sections 11, 21 and are interconnected via a spring element 30 by applying contact forces pressing against one another. Therefore, the spring element 30 surrounds the connection 5 from the outside.

Figure 3:
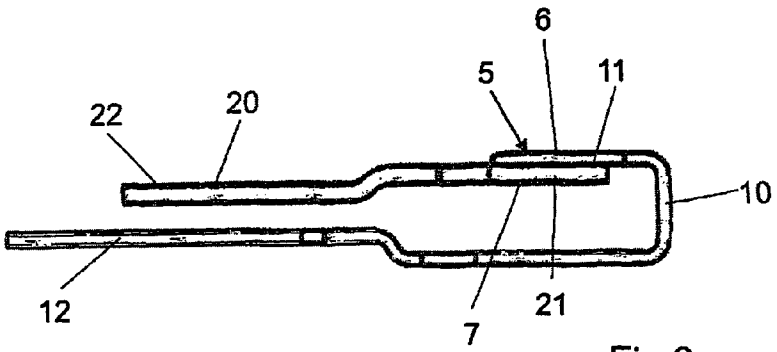
FIG. 3 is a sectional view of the connecting elements within the connection, wherein the spring element has been omitted for the purpose of illustration.

In the sectional view shown in FIG. 3, the relative arrangement of the two connecting elements 10, 20 with respect to each other can be seen best when these are in a position forming the connection 5. The connecting elements 10, 20 are here arranged relative to each other in the way how they would be positioned on account of the spring element 30 provided in the area of the contact sections 11, 21. For the sake of clarity and for explaining the designations used hereinafter, the spring element 30 is omitted in FIG. 3. Reference numeral 6 marks a first outer surface. The first outer surface 6 is the side or area of the contact section that does not represent the electrical connection with the contact section 21 of the other connecting element 20. Reference numeral 7 marks a second outer surface which is opposite to the first outer surface. As can readily be seen in FIG. 3, the second outer surface is the surface of the contact section 21 that does not form the electrical connection with the contact section 11 of the first connecting element 10.

At the end 12 of the connecting element 10 that faces away from the contact section 11, a contact element of an energy storage device or of a battery cell (not shown) can be connected. In conformity with the available space in an energy storage device, the connecting element 10 in a lateral view has the shape of a hook. This is just due to a specific installation situation in an energy storage device. In principle, the connecting element 10 could extend outside the contact section 11 in any desired way. At the end 22 of the connecting element 20 that faces away from the contact section 21, an electrical conductor 25 is connected via its cable connection element 26 (FIG. 1). It is of minor relevance to the present invention how the connecting elements 10, 20 are connected to the cable and the cable connection element 26, respectively, and to the contact element (not shown) of an energy storage device or of a battery cell. The configuration of the connecting elements for contacting the contact partners must be chosen in response to the circumstances and is of no relevance to the present invention.

Aluminum or copper or alloys thereof are preferably used as materials for the connecting elements 10, 20, including their contact sections. Selectively, one of the two connecting elements 10, 20 may consist of aluminum or an aluminum alloy and the other connecting member may consist of copper or a copper alloy. It is also possible that both connecting elements consist of aluminum or an aluminum alloy or of copper or a copper alloy.

When the HC plug-in connector 1 is used in an automotive vehicle for the electrification of an energy storage device for a drive machine, preferably aluminum or an aluminum alloy is used in at least one of the two connecting elements because the contact terminals of the energy storage device also consist of aluminum. In comparison with copper, aluminum has the advantage of a relatively low weight. By contrast, copper or a copper alloy is often used for the second connecting element because it can be connected in a simple and established way to corresponding electrical conductors, e.g. the illustrated cable 25 and its cable connection element 26, respectively.

Since the contact sections 11, 21 of the connecting elements 10, 20 are clamped by the spring element 30 directly, i.e. without interposition of further components, onto each other, any desired material combinations are possible. This is specifically due to the omission of a contact spring between the contact sections 11, 21 of the connecting elements 10, 20.

It is preferred when the connecting elements 10, 20 have a respective coating (not shown) in the area of their respective contact sections. Since the connecting elements 10, 20 in the area of their contact sections 11, 21 are in contact with each other over a large area, the coating need not consist of expensive (and highly conductive) silver. Instead of this, tin can be used, which is much cheaper. On account of the significantly lower costs of tin over silver, the thickness of the coating can thus be increased from not more than 10 μm in former times up to 100 μm. Preferably, a layer thickness between 20 μm and 70 μm, particularly 50 μm, is chosen.

The enlarged layer thickness has the advantage that the lifetime of the plug-in connection can be prolonged because a permanent protection of the surfaces of the contact sections against oxidation is made possible. During operation of the plug-in connector, in which the connecting elements are interconnected by the spring element in a force-locking manner, minor relative movements occur in relation to each other and these will remove the coating(s) in the course of time. In the case of a merely thin coating of up to 10 μm, this coating may be removed completely over the lifetime, for instance, of an energy storage device of an automotive vehicle, resulting in oxidation phenomena on the connecting elements. By contrast, the flat coating of the contact sections 11, 21 has the consequence that surface roughnesses of the coating(s) are removed by way of the relative movement of the connecting elements 10, 20 to each other, whereby the contact between the contact sections 11, 21 is further improved. There is also no risk that the coating of one of the contact sections 11, 21 is removed entirely, so that the above-described oxidation effects do not (cannot) occur.

In the simplest variant, the coating (not shown) exclusively consists of tin. In alternative variants, the coating may comprise at least one intermediate layer of copper and/or nickel. The intermediate layer(s) is (are) then arranged between the tin as the outermost layer and the contact section of the connecting element. The layer thicknesses of a respective intermediate layer are between 2 μm and 8 μm. It is here preferred when the total layer thickness is not greater than 100 μm. By providing one or plural intermediate layers consisting of the said materials, one can advantageously solve the problem of an electrochemical series (contact corrosion), which exists in the case of different materials of the two connecting elements 10, 20. This can also improve the reliability of the plug-in connector 1 over the lifetime.

A layer of copper and/or a copper alloy and/or nickel and/or a nickel alloy and/or silver and/or a silver alloy and/or gold and/or a gold alloy may be applied as the cover layer of the coating. Preferably, the cover layer has a thickness of 0.01 μm to 5 μm, particularly a thickness of 0.1-0.3 μm.

The contact surfaces of the contact sections are coated e.g. galvanically and/or by hot-dip coating and/or by deposition from the gas phase and/or by flame spraying and/or by plasma spraying and/or by compacting.

Figure 2:
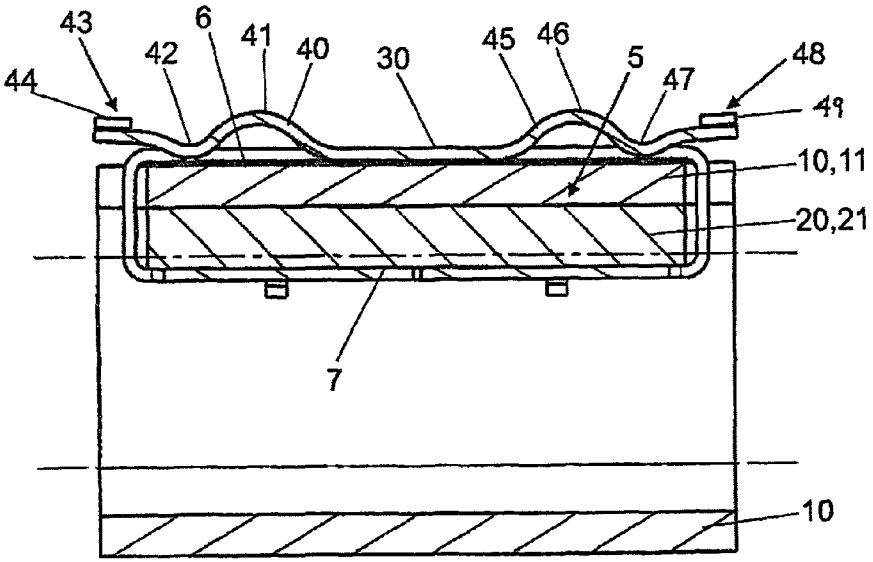
FIG. 2 is a section through the connection, which illustrates the connecting elements and the spring element for making the invention.

The configuration of the spring element 30 shall be explained in more detail hereinafter with reference to FIGS. 1 and 2. The spring element 30 comprises two clamping elements 32, 35 that are interconnected via a web 31. The clamping elements 32, 35 extend in parallel with each other, the web 31 connecting them in a top view approximately in the center in the direction of a plug-in direction SR. From the top, i.e. from the first outer surface 6, the spring element 30 has the shape of an "H". Plug-in direction SR stands for the direction of movement in which the connecting element(s) 10, 20 must be introduced into the spring element 30 to establish the connection 5, or vice versa. The web 31 and respective first sections 33, 36 of the clamping elements are arranged on the first outer surface 6. The first sections 33, 36 are guided around respective front sides of the connection 5 (i.e. of the contact sections 11, 21 superposed on each other) and terminate in second sections 34, 37 of the clamping elements that are arranged on the second outer surface 7. Preferably, respective ends of a clamping element 32, 35 are interconnected mechanically, particularly by form closure or material bonding. Specifically, the connection of respective ends of a clamping element 32, 35 is established on the second outer surface 7.

Contact springs 40, 45 are arranged on the web 31 on its opposite sides. The contact springs 40, 45 have each a wave profile (cf. FIG. 2). Starting from the web 31, the wave profile first has a wave peak 41, 46 and then a wave valley 42, 47 in contact with the first outer surface 6. The integrally formed spring element 30 consists of spring steel. Due to the described shaping of the wave profile, the wave valleys 42, 47 produce a contact force which is oriented in the direction of the second outer surface 7. Mutually facing contact surfaces of the first and the second contact section 11, 21 are thereby pressed against each other. The second sections 34, 37 of the clamping elements serve as abutments.

As follows particularly from the sectional view of FIG. 2, the last wave valley 42, 47 of the wave profile 40, 45 passes, starting from the web 31, into a section 43, 48 which is T-shaped (when viewed from above). The opposite arms 44, 49 of the T-shaped section 43, 48 have a deformation which faces away from the connection 5. Said upwardly oriented deformation, in turn, can more clearly be seen in the illustration of FIG. 1, particularly the T-shaped section 48. The deformations of the T-shaped section 43, 48 serve to provide a forceless establishment of the connection or a forceless disconnection of the connection. This is accomplished by way of the insulating housing 70, which is described in more detail hereinafter.

The clamping element 35, which represents a so-called inner clamping element, has formed thereon a stop shoulder 50 extending in the direction of the contact force. Said shoulder ends in a section 53, which extends in parallel with the connecting element 20 and can lie thereon. Moreover, lugs 51, 52 are formed on the inner clamping element 35. These are fastened to the second section 37 of the inner clamping element 35 and grip around a constriction 23 of the connecting element 20. The spring element 30 is thereby connected in a form-locking manner to the connecting element 20. It follows that for the establishment of the connection 5 the contact section 11 of the first connecting element 10 has to be introduced in plug-in direction SR into the spring element 30, with the contact section 21 of the second connecting element 20 being already supported therein in a stationary manner.

Figure 4:
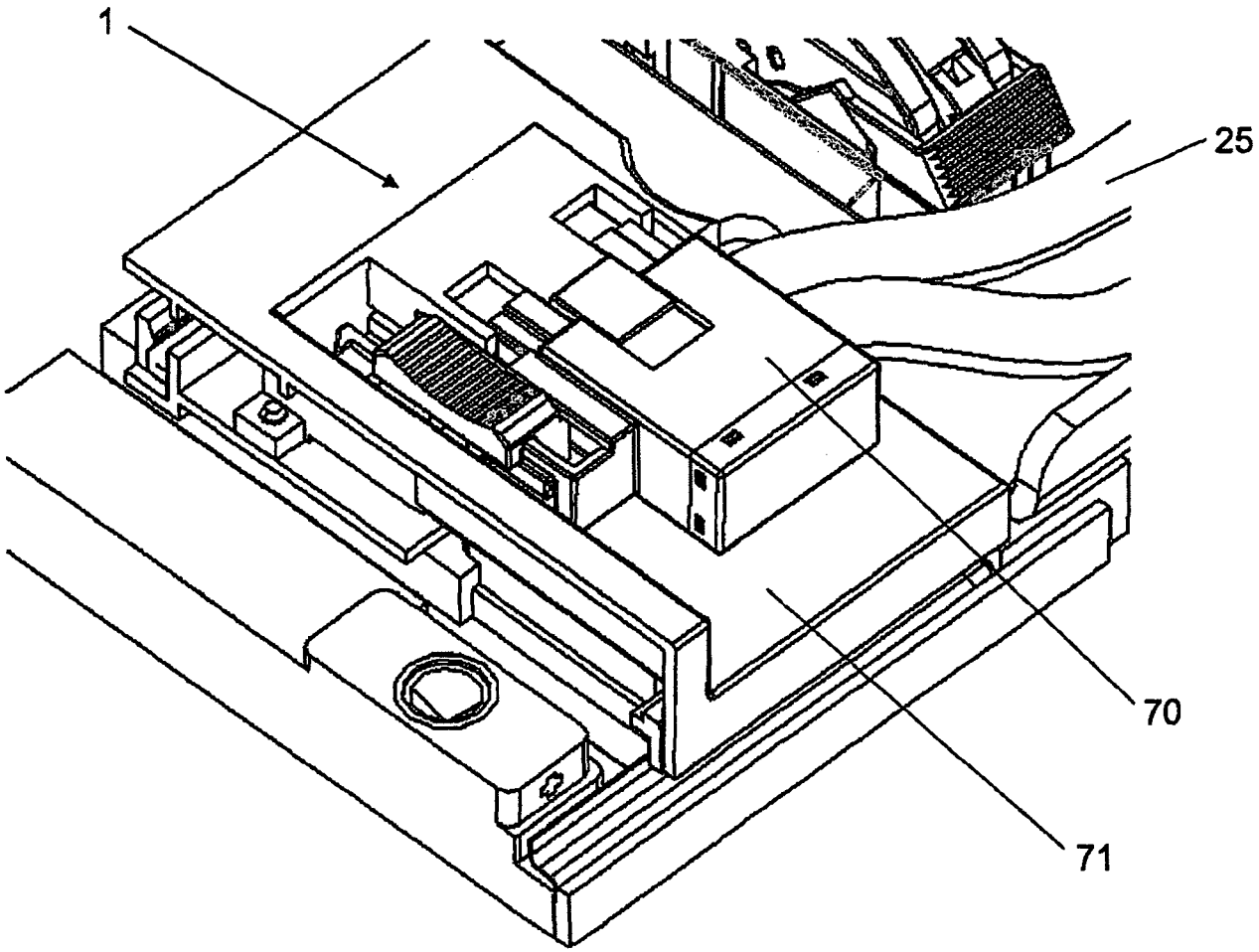
FIG. 4 is a perspective view of a high-current plug-in connector according to the invention, in which the connection is surrounded by an insulating housing.
Figure 5:
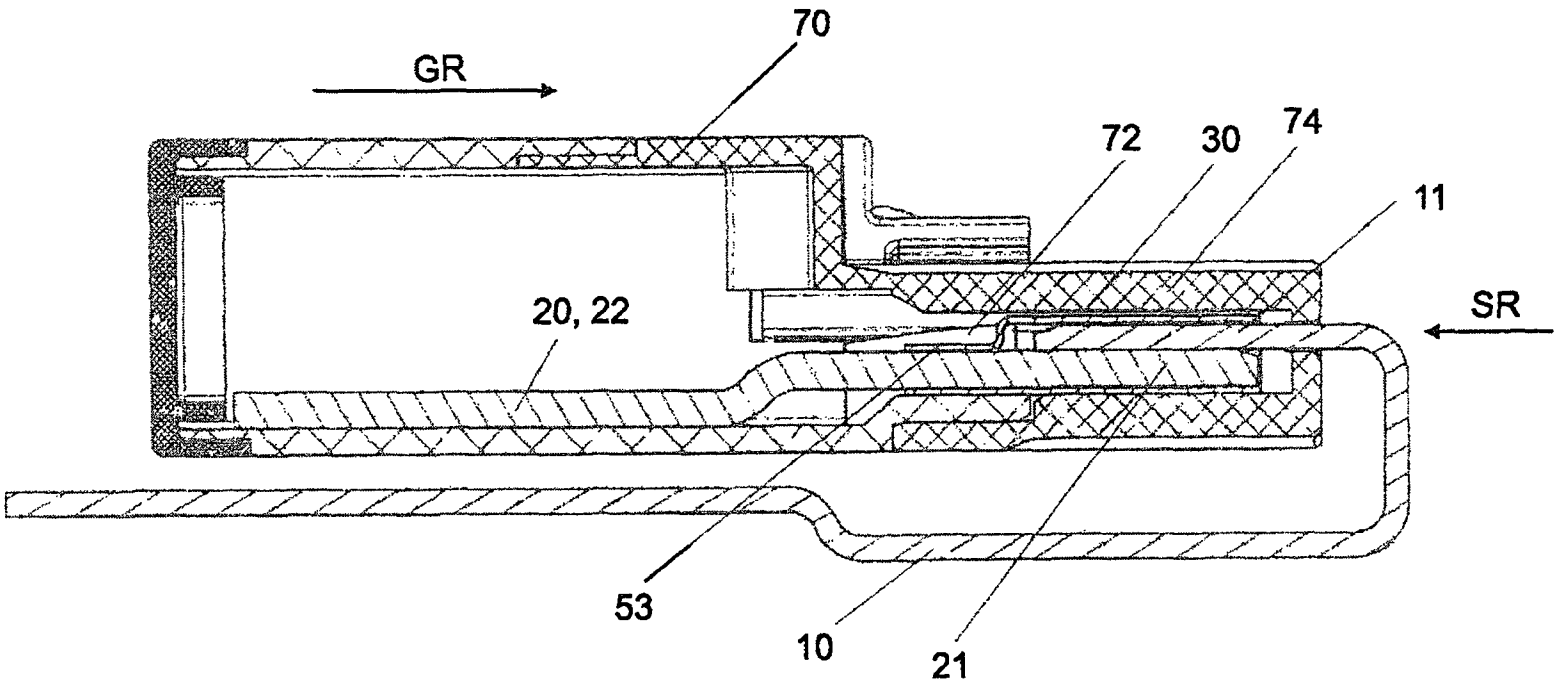
FIG. 5 is a section in longitudinal direction through the housing mounted on the connection, said housing being located in an intermediate position.
Figure 6:
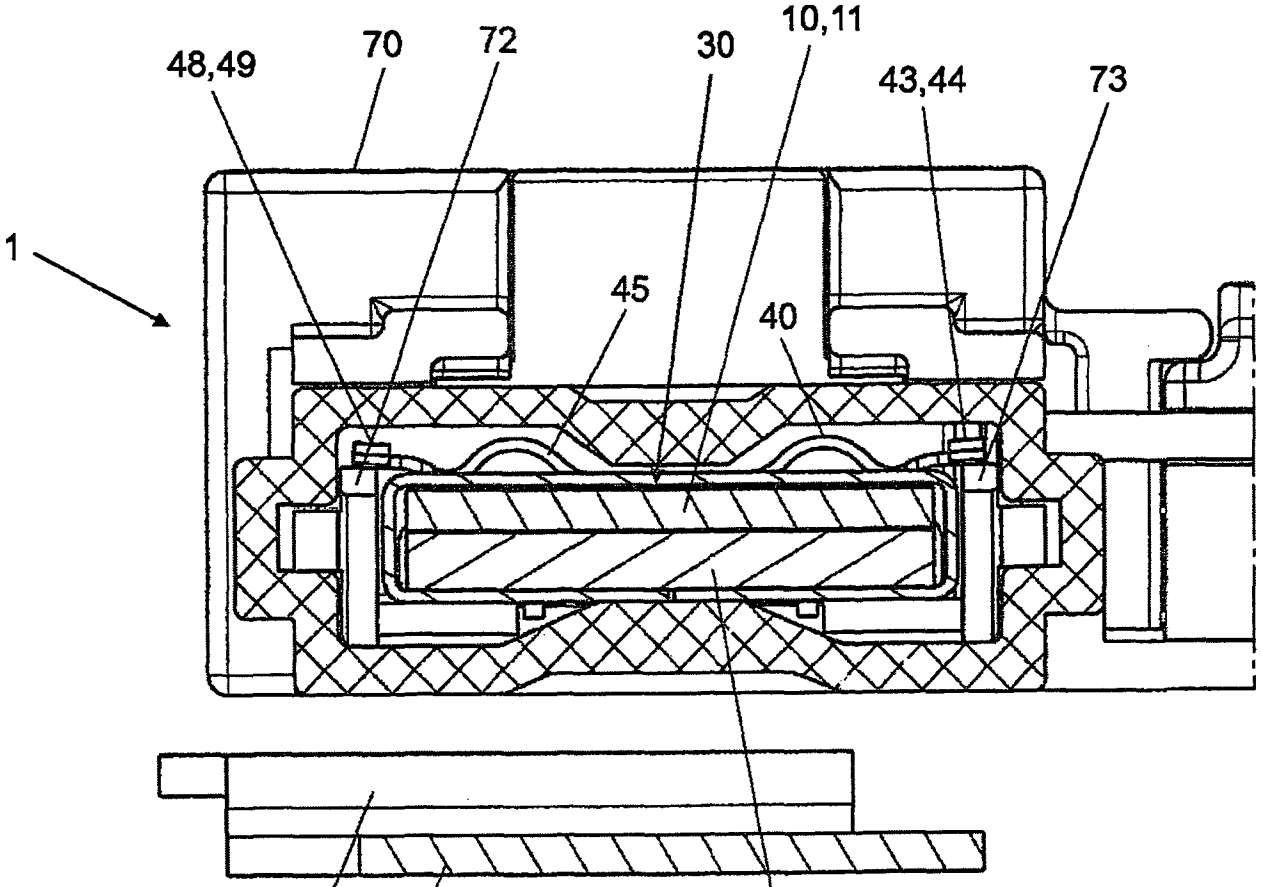
FIG. 6 is a further section in transverse direction through the high-current plug-in connector according to the invention, in which the housing in its end position is arranged over the connection.

FIGS. 4 to 6 show the HC plug-in connector 1 once in a perspective configuration and in two different sectional views, said connector being surrounded by an insulating housing 70, particularly made of plastics. The cable 25 shown in FIG. 1 is evident from the perspective representation, the cable connection element 26 being concealed underneath the housing 70. The housing 70 and the HC plug-in connector 1, which is surrounded by the housing, are "surrounded" by an insulation plate 71 which covers all voltage-conducting parts of the energy storage device, which is shown in the embodiment, to provide protection against contact. In the perspective FIG. 4, a contact element 2 of the energy storage device is also shown by way of example.

FIG. 5 shows a section through the arrangement shown in FIG. 4, the housing 70 being disposed in an intermediate position. In its interior the housing 70 comprises two guide sections 72, 73 that are arranged at opposite sides and define a path. The illustration of FIG. 5 just shows the guide section 72 on a side wall of the housing 70. The path 72 has a ramp-like course. The second connecting element 20 is surrounded by the housing 70; the cable connection element 26 which is arranged on the cable connection surface 22 is particularly contained therein. Because of the form-locking connection of the second connecting element 20 with the spring element 30, this element is also encompassed by the housing 70.

When the housing 70 is now pushed in direction GR over the connection, the contact springs 40, 45 are lifted in an intermediate position of the housing by the guide sections 72, 73 against their spring force from the connection to be established. A forceless introduction of the connecting element 10, which is not connected to the spring element 30, into the spring element 30 can thereby be made possible in plug-in direction. When the housing is further pushed in direction GR into its end position, the spring contacts 40, 45 are again released on account of the path of the guide section, whereby these can exert their contact force on the contact sections of the connecting elements 10, 20. The engagement of the guide sections 72, 73 with the contact springs 40, 45 takes place in the area of the arms 44, 49 of the T-shaped sections 43, 48 of the contact springs. To enable the guide sections to "slide" under the spring contacts, the arms 44, 49 are bent away from the connection 5, as has been described. FIG. 6 shows the housing in its end position in a cut illustration, wherein both guide sections 72, 73 that are acting on the T-shaped sections 48, 43 can now be seen on account of the cutting direction.

It is clear to a person skilled in the art that the configuration of the spring element 30 shown in the present description is just by way of example. Specifically, the number of the contact springs, the arrangement of the web for the connection of the clamping elements, the number of the clamping elements can be modified according to the requirements. It must be ensured at any rate that the necessary contact force is provided, which permits a direct, force-locking connection without any interposed components of the contact sections of the connecting elements.

The plug-in connector according to the invention has the advantage of low contact resistances. Temperature increases caused by current flow are thereby reduced in comparison with arrangements known from the prior art. The externally positioned spring element provides a small construction volume for the plug-in connector. A longer lifetime is achieved due to the flat contacting of the current-transferring connecting elements. The plug-in connector has a low weight due to the low complexity of the plug-in connector.

LIST OF REFERENCE NUMERALS

1 High-current plug-in connector
2 Contact element
5 Connection
6 First outer surface of the connection
7 Second outer surface of the connection
10 First connecting element
11 First contact section
12 Cell connection surface
20 Second connecting element
22 Cable connection surface
23 Constriction
25 Cable
26 Cable connection element
30 Spring element
31 Web
32 (Outer) clamping element
33 First section of the clamping element 32 on the first outer surface 6
34 Second section of the clamping element 32 on the second outer surface 7
35 (Inner) clamping element
36 First section of the clamping element 35 on the first outer surface 6
37 Second section of the clamping element 35 on the second outer surface 7
40 Contact spring
41 Wave peak
42 Wave valley
43 T-shaped section
44 Arm of the T-shaped section 43
45 Contact spring
46 Wave peak
47 Wave valley
48 T-shaped section
49 Arm of the T-shaped section 48
50 Stop shoulder
51 Lug
52 Lug
53 Section
70 Housing
71 Insulation plate
72 Guide section
73 Guide section
SR Plug-in direction
GR Movement direction of the housing when the connection is established

The invention claimed is:

1. A high-current (HC) plug-in connector for currents exceeding 100 A, in particular 200 A, comprising:

a first connecting element having a first contact section, a second connecting element having a second contact section, a spring element for establishing an electrical connection between the first and the second connecting element, characterized in that the spring element comprises at least two clamping elements which are interconnected via at least one web, the web and respective first sections of the clamping elements being arranged on a first outer surface of the electrical connection formed by the first and the second contact section, and second sections of the clamping elements being arranged at least in part on a second outer surface opposite the first outer surface;

at least one contact spring is arranged on the at least one web, said at least one contact spring generating, on the first outer surface, a contact force oriented in the direction of the second outer surface, whereby mutually facing contact surfaces of the first and the second contact section are pressed against each other, the second sections of the clamping elements serving as abutments.

2. The high-current plug-in connector according to claim 1, wherein the first and the second contact section are in direct contact with each other.

3. The high-current plug-in connector according to claim 1, wherein at least one contact spring is respectively arranged on the at least one web on opposite sides.

4. The high-current plug-in connector according to claim 1, wherein the at least one contact spring has a wave profile, wherein the wave profile, starting from the web, first has a wave peak and then a wave valley which is in contact with the first outer surface and which generates the contact force.

5. The high-current plug-in connector according to claim 4, wherein the at least one contact spring extends in parallel with the clamping elements and perpendicular to a plug-in direction of the first and the second connecting element for establishing the plug-in connection of the plug-in connector.

6. The high-current plug-in connector according to claim 4, wherein, starting from the web, the last wave valley of the wave profile passes into a T-shaped section, the opposite arms of the T-shaped section having a deformation facing away from the electrical connection.

7. The high-current plug-in connector according to claim 1, wherein the spring element comprises at least two clamping elements extending in parallel with each other, the at least one contact spring being arranged between two respective clamping elements.

8. The high-current plug-in connector according to claim 1, wherein respective ends of a clamping element, particularly on the second outer surface of the electrical connection, are interconnected mechanically, especially by form closure or material bonding.

9. The high-current plug-in connector according to claim 1, wherein the spring element on an inner one of the clamping elements comprises a stop shoulder extending in the direction of the contact force.

10. The high-current plug-in connector according to claim 8, wherein the inner clamping element has formed thereon at least one lug enclosing one of the connecting elements in the area of a constriction to connect the spring element in a form-locking manner to said connecting element.

11. The high-current plug-in connector according to claim 1, wherein the plug-in connector after establishment of the electrical connection between the first and the second connecting element is surrounded by an insulating housing, particularly made of plastics.

12. The high-current plug-in connector according to claim 11, wherein the housing comprises at least one guide section including a path, which upon mounting of the housing on the spring element in an intermediate position lifts off the at least one contact spring in a direction opposite to its spring force from the electrical connection to be established so as to permit—in plug-in direction—a forceless introduction of the connecting element, which is not connected to the spring element, into the spring element, wherein in an end position of the housing the at least one guide section is not in engagement with the spring element so as to permit the generation of the contact force by the spring element.

13. The high-current plug-in connector according to claim 1, wherein the contact sections of the connecting elements are made flat, particularly plane or concave and convex.

14. The high-current plug-in connector according to claim 1, wherein the spring element is made from special steel.

15. The high-current plug-in connector according to claim 1, wherein the contact surfaces of the first and/or the second contact section consist of aluminum or of copper or of the alloys thereof.

16. The high-current plug-in connector according to claim 1, wherein the contact surfaces of the first and/or second contact sections (11, 12) have each a surface coating consisting of tin and/or a tin alloy.

17. The high-current plug-in connector according to claim 16, wherein the surface coating has a thickness of 20 μm to 100 μm, and particularly a thickness of 20 μm to 70 μm.

18. The high-current plug-in connector according to claim 16, wherein an intermediate layer of copper and/or a copper alloy and/or nickel and/or a nickel alloy is arranged between the base material of the first and/or second contact section and the surface coating.

19. The high-current plug-in connector according to claim 18, wherein the intermediate layer has a layer thickness of 1 μm to 20 μm, particularly a thickness of 2 μm to 8 μm.

20. The high-current plug-in connector according to claim 16, wherein a cover layer of copper and/or a copper alloy and/or nickel and/or a nickel alloy and/or silver and/or a silver alloy and/or gold and/or a gold alloy is applied to the surface coating.

21. The high-current plug-in connector according to claim 20, wherein the cover layer has a thickness of 0.01 μm to 5 μm, particularly a thickness of 0.1 μm to 0.3 μm.

22. The high-current plug-in connector according to claim 16, wherein the surface coating is applied galvanically and/or by hot-dip coating and/or by deposition from the gas phase and/or by flame and/or by plasma spraying and/or by compacting.

* * * * *